US009945600B2

(12) United States Patent
Kang

(10) Patent No.: US 9,945,600 B2
(45) Date of Patent: Apr. 17, 2018

(54) REFRIGERATOR

(71) Applicant: LG ELECTRONICS INC., Seoul (KR)

(72) Inventor: Daekil Kang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/312,158

(22) PCT Filed: Jun. 18, 2015

(86) PCT No.: PCT/KR2015/006207

§ 371 (c)(1),
(2) Date: Nov. 17, 2016

(87) PCT Pub. No.: WO2016/195150

PCT Pub. Date: Dec. 8, 2016

(65) Prior Publication Data

US 2017/0176093 A1 Jun. 22, 2017

(30) Foreign Application Priority Data

Jun. 4, 2015 (KR) ..... 10-2015-0079447

(51) Int. Cl.
*A47B 96/04* (2006.01)
*F25D 23/06* (2006.01)
*F25D 11/02* (2006.01)

(52) U.S. Cl.
CPC ..... *F25D 23/066* (2013.01); *F25D 11/02* (2013.01); *F25D 23/069* (2013.01); *F25D 2201/126* (2013.01); *F25D 2400/04* (2013.01)

(58) Field of Classification Search
CPC ..... F25D 23/066; F25D 23/069; F25D 11/02; F25D 2201/126; F25D 2400/04
See application file for complete search history.

(56) References Cited

U.S. PATENT DOCUMENTS 4,627,246 A * 12/1986 Wilson ..... F25D 23/069 312/129
5,842,760 A * 12/1998 Gatti ..... F25D 23/064 220/592.1

(Continued)

FOREIGN PATENT DOCUMENTS

EP 2 299 215 3/2011
EP 2 685 183 1/2014

(Continued)

OTHER PUBLICATIONS

European Search Report dated Mar. 15, 2017 issued in Application No. 16197049.6.
Korean Office Action dated Mar. 15, 2017 issued in Application No. 10-2015-0079447 (with English translation).
Korean Notice of Allowance dated Jun. 7, 2017 issued in Application No. 10-2015-0079447.

(Continued)

*Primary Examiner* — Hanh V Tran
(74) *Attorney, Agent, or Firm* — KED & Associates, LLP

(57) ABSTRACT

Disclosed is a refrigerator an outer case, an inner case including storage spaces integrally manufactured so as to have a first set value, a barrier disposed within the storage space to vertically divide the storage space into a plurality of storage chambers so that the heights of openings of the respective storage chambers have a second set value and a third set value, and including first communication parts on the side surfaces of the barrier, second communication parts formed on the inner case, and a foamed heat insulating material filling the inside of the barrier by causing a foaming liquid, injected from the outer case, to pass through the second communication parts and the first communication parts and then foaming the foaming liquid within the barrier, wherein the first set value is 1.5 times or more at least one of the second set value and the third set value.

16 Claims, 6 Drawing Sheets

(56) References Cited

U.S. PATENT DOCUMENTS

| | | | | |
|---|---|---|---|---|
| 6,209,342 | B1 * | 4/2001 | Banicevic | F25D 17/067 312/407 |
| 6,290,314 | B1 | 9/2001 | Kim | |
| 2004/0183415 | A1 | 9/2004 | Kim | |
| 2007/0205705 | A1 * | 9/2007 | Middleton | F25D 17/042 312/401 |
| 2007/0227179 | A1 * | 10/2007 | Yoo | F25D 23/066 62/440 |
| 2010/0181883 | A1 * | 7/2010 | Kim | F25D 23/064 312/405 |
| 2010/0213805 | A1 * | 8/2010 | Brown | F25D 23/064 312/404 |
| 2012/0011879 | A1 * | 1/2012 | Gu | F25D 17/065 62/408 |
| 2012/0103006 | A1 * | 5/2012 | Jung | F25D 23/062 62/440 |
| 2012/0104923 | A1 * | 5/2012 | Jung | F25D 23/066 312/406 |
| 2014/0015394 | A1 * | 1/2014 | Cha | B23P 15/26 312/404 |
| 2015/0027247 | A1 | 1/2015 | Kamada | |

FOREIGN PATENT DOCUMENTS

| | | |
|---|---|---|
| JP | H 11-101573 | 4/1999 |
| JP | 2000-161843 | 6/2000 |
| JP | 2000-180040 | 6/2000 |
| JP | 2000-329454 | 11/2000 |
| JP | 2004-092925 | 3/2004 |
| JP | 3540571 | 7/2004 |
| JP | 2008-008550 | 1/2008 |
| JP | 2009-228911 | 10/2008 |
| JP | 2009-115368 | 5/2009 |
| KR | 10-2014-0009647 | 1/2014 |
| WO | WO 2015/131778 | 9/2015 |
| WO | WO 2016/129956 | 8/2016 |

OTHER PUBLICATIONS

International Search Report and Written Opinion dated Mar. 4, 2016 issued in Application No. PCT/KR2015/006207 (Full English Text).
European Search Report dated Nov. 30, 2017 issued in Application No. 15894323.3.

* cited by examiner

[Fig. 1]
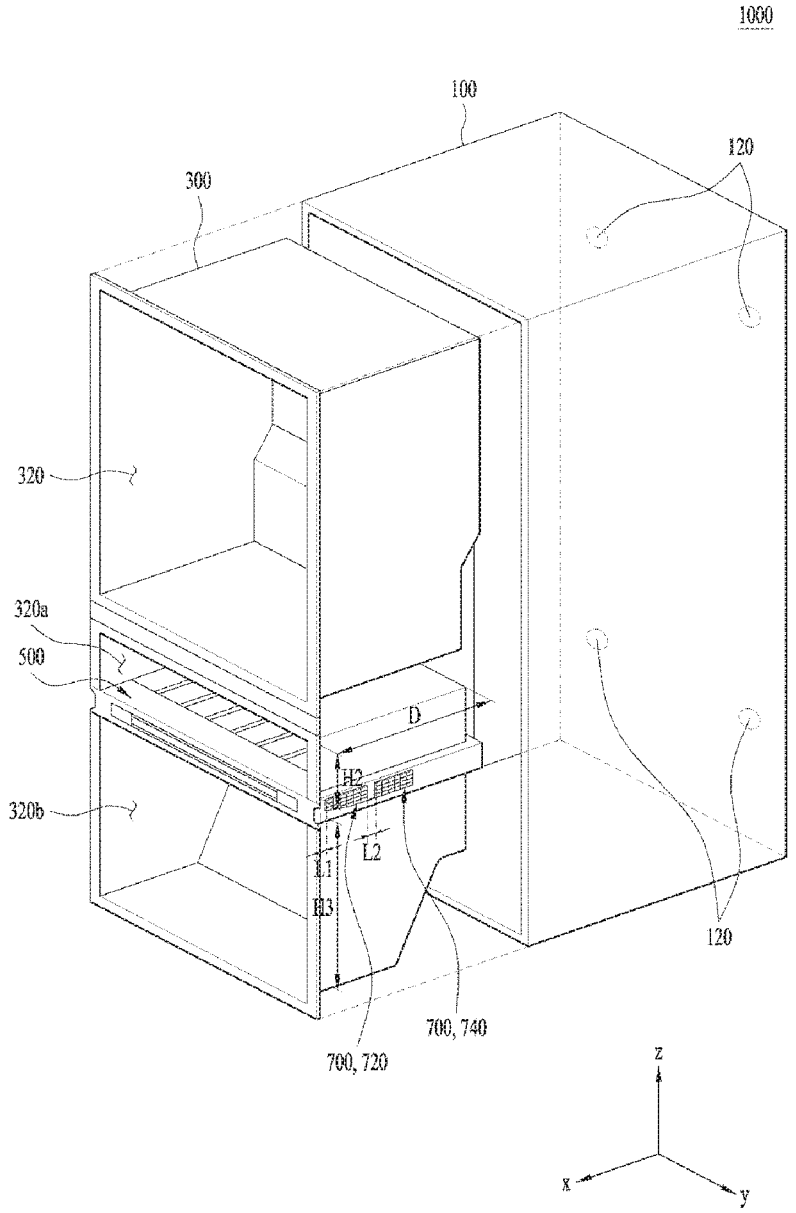

[Fig. 2]
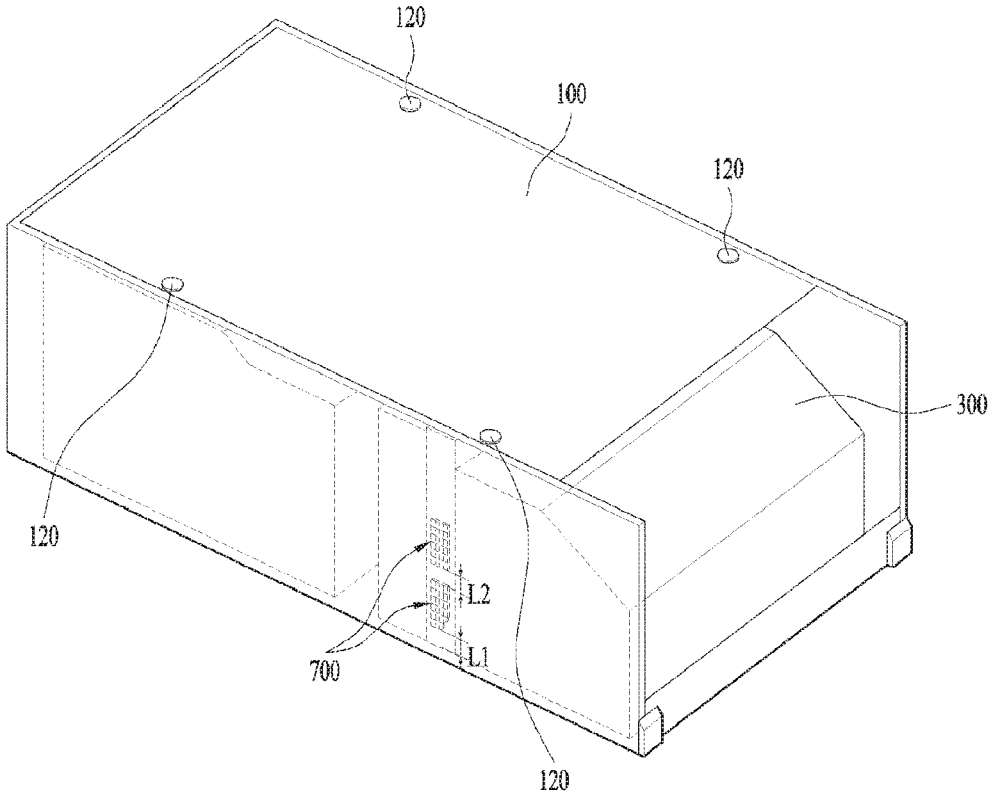
[Fig. 3]
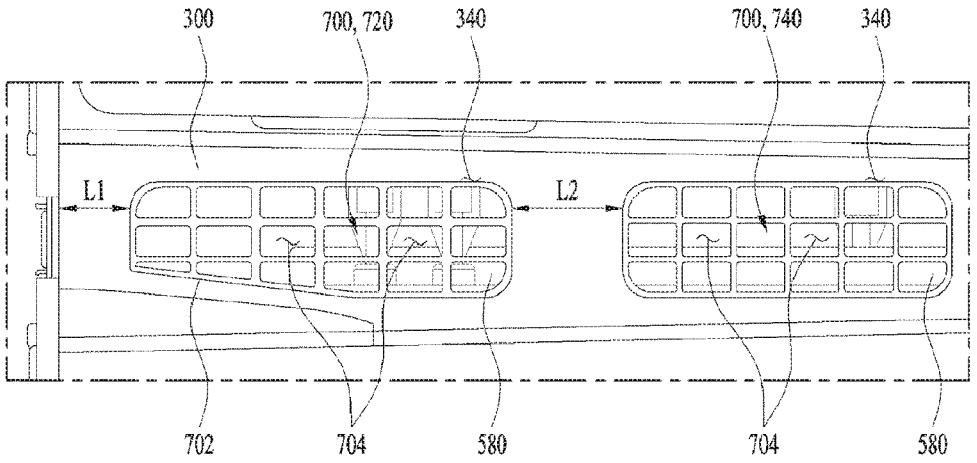

[Fig. 4]
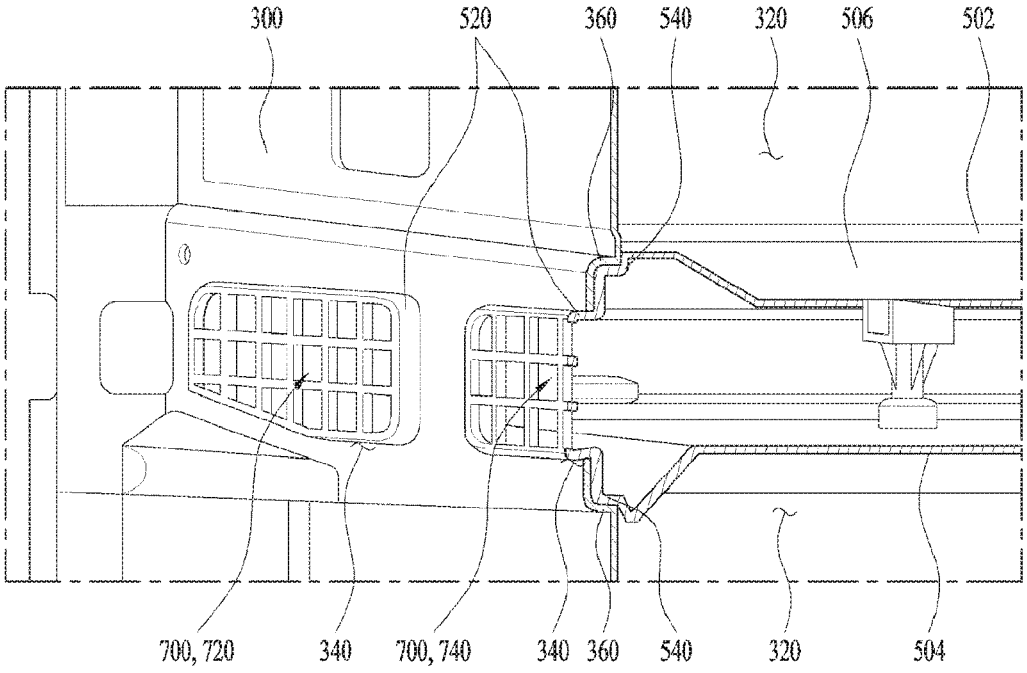

[Fig. 5]
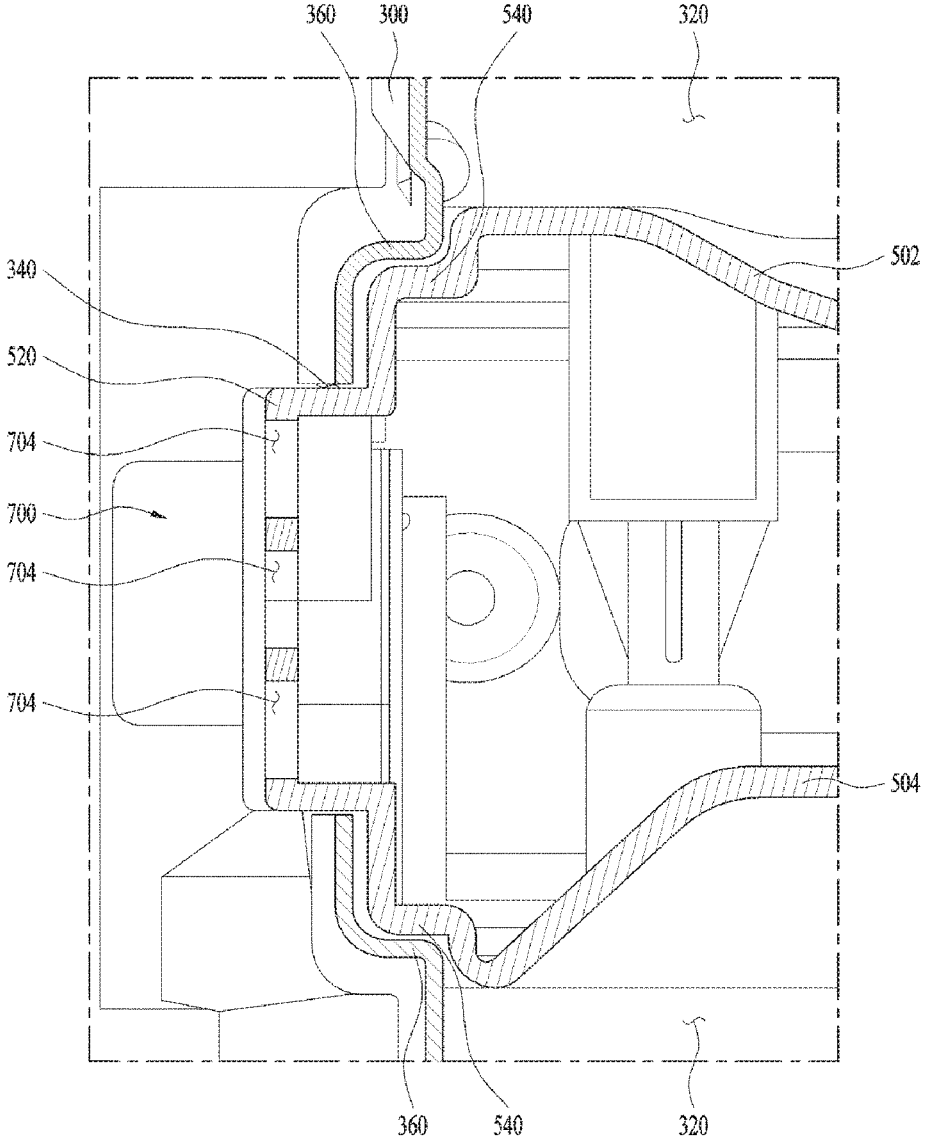

[Fig. 6]
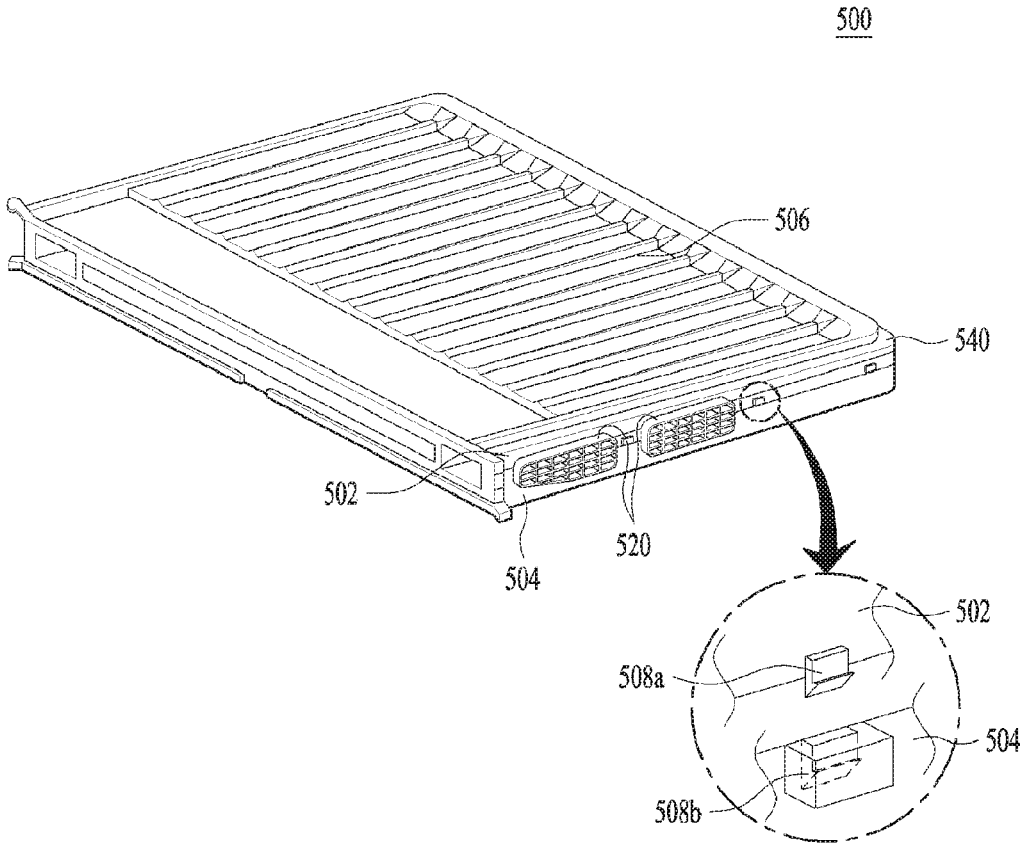

REFRIGERATOR

CROSS-REFERENCE TO RELATED PATENT APPLICATIONS

This application is a U.S. National Stage Application under 35 U.S.C. § 371 of PCT Application No. PCT/KR2015/006207, filed Jun. 18, 2015, which claims priority to Korean Patent Application No. 10-2015-0079447, filed Jun. 4, 2015, whose entire disclosures are hereby incorporated by reference.

TECHNICAL FIELD

The present invention relates to a refrigerator, and, more particularly, to a refrigerator having a barrier to divide storage chambers from each other.

BACKGROUND ART

In general, a refrigerator supplies cool air generated using a refrigeration cycle to storage chambers and stores articles in a low temperature state in the storage chambers.

The storage chambers provided in the refrigerator include a refrigerating chamber to store food in a low temperature state and a freezing chamber to store food in a frozen state.

The refrigerator includes a cabinet including the storage chambers, doors provided on the cabinet to open and close the storage chambers, and a cooling system to supply cool air to the storage chambers using the refrigeration cycle.

The cabinet includes an inner case having a space to form the storage chambers and an outer case surrounding the inner case, a foamed heat insulating material for heat insulation fills a space between the outer case and the inner case, and the cooling system including a compressor, a heat exchanger and the like is provided at the lower part of the cabinet.

The outer case is formed of a metal and the inner case is formed of a resin having excellent impact resistance and heat resistance. In this case, an acrylonitrile butadiene styrene (ABS) copolymer may be used as the resin.

The door also includes an inner case and an outer case, a foamed heat insulating material fills a space between the inner case and the outer case, the outer case is formed of a metal, and the inner case is formed of a resin.

The outer cases of the cabinet and the doors are manufactured by pressing and punching a metal sheet.

The inner cases of the cabinet and the doors are manufactured using a vacuum molding method.

In case of the vacuum molding method, a resin sheet for molding is heated so as to be easily deformed and then located at a vacuum case, one side of which is opened, and the inside of the vacuum case is evacuated so that a part of the heated sheet is introduced into the vacuum case. Here, since the edge of the resin sheet is fixed to the outside of the vacuum case, the middle part of the resin sheet swells and is sucked into the vacuum case and, thus, the resin sheet is firstly molded.

Thereafter, a mold having a shape corresponding to a desired inner case is located close to the firstly-molded resin sheet, air of a high pressure is supplied to the inside of the vacuum case so that the resin sheet is closely attached to the mold and, thus, the firstly-molded resin sheet is secondarily molded.

Thereafter, the resin sheet closely attached to the mold is cooled and then, an acquired molded inner case product is released from the mold, unnecessary parts are removed from the acquired molded the inner case product, and grooves and the like required for assembly are formed on the molded inner case product.

In such a vacuum molding method of the inner case, if the height of a storage chamber is less than the depth of the storage chamber, when the resin sheet heated during vacuum molding swells and is sucked into the vacuum case, the resin sheet may tear. The reason for this is that, if the depth of the storage chamber is increased, the storage chamber having a large volume needs to be molded using the resin sheet having a designated area and thus the resin sheet swells, decreases in thickness, and then tears.

Due to such a problem, if the depth of the storage chamber is great, after a barrier to divide the storage chamber is separately manufactured and the inside of the barrier is filled with a foamed heat insulating material, such as Styrofoam, the barrier is installed within the inner case. Otherwise, after a space between the inner case and the outer case of the cabinet is filled with a foamed heat insulating material, a space between the inner case and the outer case of the barrier is filled with a foamed heat insulating material, i.e., a foaming process is carried out twice.

However, in the former method in which the barrier filled with a foamed heat insulating material is separately manufactured and installed in the inner case, a gap is generated between storage chambers and, thus, the storage chambers are not completely divided from each other, and a new process for filling the inside of the barrier is required and thus material costs and investment costs are generated.

Further, in the latter method in which the inside of the barrier is filled with a foamed heat insulating material after filling of a space between the inner case and the outer case with a foamed heat insulating material, urethane foam may be deformed and a foaming liquid may leak through a gap of a sealing surface between the inner case and the barrier.

DISCLOSURE OF INVENTION

Technical Problem

An object of the present invention is to provide a refrigerator including a cabinet having a formed insulation material integrally formed by simultaneously foaming a space between an outer case and an inner case and the inner space of a barrier.

Another object of the present invention is to provide a refrigerator in which heat insulation efficiency and strength of a barrier to divide a storage chamber are increased.

Yet another object of the present invention is to provide a refrigerator including a barrier to produce storage chambers having various sizes and volumes regardless of the depths and heights of the storage chambers.

Technical objects to be accomplished by the present invention are not limited to the above objects, and other technical objects which are not stated will become apparent to those skilled in the art from the embodiments of the present invention given hereinbelow.

Solution to Problem

In one embodiment of the present invention, a refrigerator includes an outer case, an inner case provided within the outer case and including storage spaces integrally manufactured by a vacuum molding method so as to have a first set value from the front surface to the rear surface of the inner case, a barrier disposed within the storage space to vertically divide the storage space formed in the inner case into a plurality of storage chambers so that the heights of openings of the respective storage chambers have a second set value and a third set value, and including first communication parts on the side surfaces of the barrier, second communication parts formed on the inner case opposite the first communication parts, and a foamed heat insulating material filling the inside of the barrier by causing a foaming liquid, injected from the outer case, to pass through the second communication parts and the first communication parts and then foaming the foaming liquid within the barrier, wherein the first set value is 1.5 times or more at least one of the second set value and the third set value.

The first communication parts and the second communication parts may communicate with each other to form communication paths.

The area of the first communication parts or the second communication parts may gradually decrease in the forward direction.

The vertical length of the first communication parts or the second communication parts may gradually decrease in the forward direction.

The first communication part or the second communication part may include injection channels provided to divide the communication path and the injection channels may have a circular or polygonal shape.

The area of the injection channels provided at the front portion of the first communication part or the second communication part may be smaller than the area of the injection channels provided at the rear portion of the first communication part or the second communication part.

The communication paths may include front communication paths provided at the front portions of the side surfaces of the inner case and rear communication paths provided at the rear of the front communication paths.

The area of the front communication paths may be smaller than the area of the rear communication paths.

The area of the front communication paths or the rear communication paths may gradually decrease in the forward direction.

The refrigerator may further include first stair parts protruding in a convex shape from the side surfaces of the barrier and insertion holes provided on the inner case so that the first stair parts are inserted into the insertion holes and protrudes to a space between the inner case and the outer case.

The outer circumferential surfaces of the first stair parts and the inner circumferential surfaces of the insertion holes may be provided in the same shape.

The first stair parts may be provided such that the area of the first stair parts gradually decreases in the forward direction.

The first communication part may be provided at one end of each of the first stair parts.

The refrigerator may further include support parts depressed in a concave shape within the storage space of the inner case and the barrier may be supported by the support parts.

The refrigerator may further include second stair parts protruding in a convex shape from the barrier and the second stair parts may be supported by the support parts.

The refrigerator may further include deformation prevention ribs formed in a convex shape on the upper surface or lower surface of the barrier to prevent deformation of the barrier.

The barrier may include an upper barrier part and a lower barrier part and posts may be provided between the upper barrier part and the lower barrier part to prevent deformation of the barrier during foaming.

The post may protrude from the upper barrier part and include a post insertion part provided at the end of the post and a post fixing part provided on the lower barrier part so that the post insertion part is inserted into the post fixing part.

The barrier may include adsorption ribs formed integrally with the barrier within the barrier to increase a contact surface area between the foamed heat insulating material and the barrier.

The refrigerator may further include sub-communication paths provided on the rear surface of the inner case so as to communicate the barrier and the inner case with each other.

Advantageous Effects of Invention

The present invention has an effect of providing a refrigerator in which a foamed heat insulating material is integrally provided within a space between an outer case and an inner case and the inner space of a barrier so as to adhere the barrier and the inner case closely to each other without gaps and to enhance cool air cut-off efficiency.

The present invention has an effect of providing a refrigerator which has excellent heat insulation efficiency to reduce power consumption and stabilizes a temperature within a storage chamber.

The present invention has an effect of providing a refrigerator in which a space between an outer case and an inner case and the inner space of a barrier are simultaneously foamed and a separate process for installing a separate barrier is omitted so as to lower costs (material costs, investment costs and the like).

Further, the present invention has an effect of providing a refrigerator which has high heat insulation efficiency and strength quality of a barrier to divide storage chambers to each other.

Further, the present invention has an effect of providing a refrigerator which provides the same strength as a barrier provided within an inner case and formed integrally with the inner case to a storage chamber having a depth greater than the height of the storage chamber.

Further, the present invention has an effect of providing a refrigerator which has storage chambers having various sizes or volumes regardless of the depths and heights of the storage chambers.

Effects acquired by the embodiments of the present invention are not limited to the above-stated effects, and other effects which are not stated herein will be apparent to those skilled in the art from the embodiments of the present invention given hereinbelow. That is, effects which are not intended according to implementation of the present invention will be deduced from the embodiments of the present invention by those skilled in the art.

BRIEF DESCRIPTION OF DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 1 is an exploded perspective view illustrating a refrigerator in accordance with one embodiment of the present invention;

FIG. 2 is a view illustrating an assembled state of an inner case with the inside of an outer case prior to filling of a space with the inner case and the outer case with a foaming liquid through filling holes;

FIG. 3 is view illustrating communication paths through which a barrier and the inner case communicate with each other;

FIG. 4 is a side view illustrating the cross-section of the barrier assembled with the inner case;

FIG. 5 is a cross-sectional view of the barrier assembled with the inner case;

FIG. 6 is a perspective view of the barrier; and

BEST MODE FOR CARRYING OUT THE INVENTION

Figure 7:
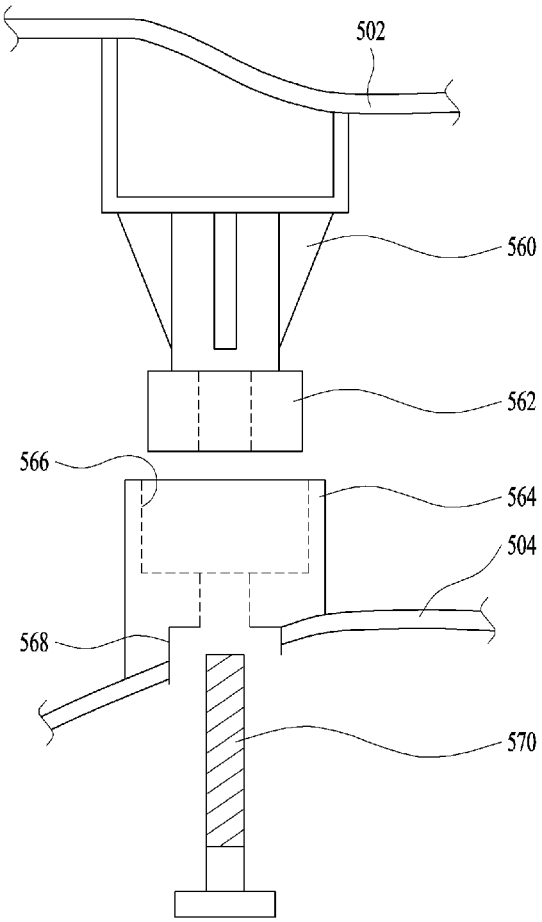
FIG. 7 is a view illustrating a structure to fix a post provided in the barrier.

Reference will now be made in detail to the preferred embodiments of the present invention, examples of which are illustrated in the accompanying drawings.

The configuration of an apparatus which will be described below has been made only for a better understanding of the embodiments of present invention and does not limit the scope and spirit of the invention, and the same reference numerals in the specification represent the same parts even though they are depicted in different drawings.

FIG. 1 is an exploded perspective view illustrating a refrigerator 1000 in accordance with one embodiment of the present invention.

With reference to FIG. 1, the refrigerator 100 in accordance with this embodiment of the present invention will be described.

Prior to a detailed description, directions used throughout the specification will be defined. In a rectangular coordinate system shown in FIG. 1, the positive direction of an x-axis is defined as a forward direction, the negative direction of the x-axis is defined as a backward direction, the positive direction of a y-axis is defined as a rightward direction, the negative direction of the y-axis is defined as a leftward direction, the positive direction of a z-axis is defined as an upward direction, and the negative direction of the z-axis is defined as a downward direction.

The refrigerator 1000 in accordance with this embodiment of the present invention includes an outer case 100 and an inner case 300.

The outer case 100 forms the external appearance of the refrigerator 1000. The front part of the outer case 100 is opened and the inner case 300 enters the outer case 100 through the opened front part of the outer case 100 and is assembled with the outer case 100. The outer case 100 is formed of a metal and the surface of the outer case 100 is coated with a paint so as to prevent corrosion or is polished to a shine.

The outer case 100 includes filling holes 120 to receive a foaming liquid after completion of assembly of an inner case or a condenser and the like, provided within a machinery room, which will be described later.

The filling holes 120 are provided on the rear surface of the outer case 100. Further, four filling holes 120 are provided, i.e., provided at the left and right regions of the upper part of the rear surface of the outer case 100 and the left and right regions of the lower part of the rear surface of the outer case 100.

Further, the filling holes 120 are provided at ends of the left side and/or right side of the rear surface of the outer case 100 so as to communicate with a space between the side surfaces of the outer case 100 and the side surfaces of the inner case 300. Thereby, the foaming liquid injected into the filling holes 120 of the outer case 100 is not stagnant on the rear surface of the inner case 300 and may fill the space between the outer case 100 and the inner case 300.

The inner case 300 is provided within the outer case 100. That is, the inner case 300 is assembled with the inside of the outer case 100 through the opened front part of the outer case 100.

In this case, a gap between the outer case 100 and the inner case 300 is sealed using an adhesive. This may prevent the above-described foaming liquid from leaking through the gap between the outer case 100 and the inner case 300.

The inner case 300 may be formed by vacuum molding. In this case, the inner case is formed of a resin having excellent impact resistance and heat resistance, i.e., an acrylonitrile butadiene styrene (ABS) copolymer resin.

That is, the inner case 300 is provided within the outer case 100 and storage spaces 320 having a first set value D from the front surface to the rear surface of the inner case 300 are integrally manufactured by vacuum molding.

The first set value D refers to a length from the opened front part to the rear surface of the inner case 300 and the rear surface of the inner case 300 may not be flat due to an evaporator (not shown) or the machinery room (not shown). Therefore, the first set value D may be a changeable value. However, in the present invention, the first set value D refers to a length from the opened front part of the inner case 300 to the vertical rear surface of the inner case 300 or the longest length out of lengths from the opened front part of the inner case 300 to the rear surface of the inner case 300.

Storage chambers, such as a refrigerating chamber and/or a freezing chamber, are provided in the inner case 300. The storage space 320 may function as one storage chamber, i.e., a refrigerating chamber or a freezing chamber. FIG. 1 illustrates one exemplary inner case 30 in which two storage spaces 320 are integrally manufactured by vacuum molding.

Recently, as eating habits have become diversified, a demand of consumers desiring to store various food materials in the refrigerator 100 increases and thus a refrigerator having three or more storage chambers is required. However, in order to increase the number of storage chambers, the number of storage spaces which may be manufactured by vacuum molding is limited. Because, in order to increase the number of storage spaces, several storage chambers need to be made within a regular refrigerant volume. In this case, as the depth of a storage chamber is greater than the height of the storage chamber, vacuum molding is limited. Since the area of a resin sheet to mold the inner case 300 is constant, when a plurality of storage chambers is made using a designated portion of the resin sheet or a storage chamber, the depth of which is greater than the height of the storage chamber, is manufactured, the resin sheet may tear or the thickness of the inner case 300 may decrease and thus the inner case 300 may tear due to a foaming pressure. Therefore, in order to solve such a problem, in the present invention, the inner case 300 includes a barrier 500 to divide the storage space 320.

The barrier 500 vertically divides the storage space 320 formed in the inner case 300 into a plurality of storage chambers 320*a* and 320*b*.

The storage chambers 320*a* and 320*b* divided from each other by the barrier 500 include a second storage chamber 320*a* located at an upper region and a third storage chamber 320*b* located at a lower region The height of the second storage chamber 320*a* is a second set value H2 and the height of the third storage chamber 320*b* is a third set value H3. In more detail, the height of the opening of the second storage chamber 320*a* is the second set value H2 and the height of the opening of the third storage chamber 320*b* is the third set value H3.

In this case, the first set value D is 1.5 times or more at least one of the second set value H2 and the third set value H3.

In other words, the height H2 or H3 of the second or third storage chamber 320*a* or 320*b* divided by the barrier 500 is less than the depth D of the second or third storage chamber 320*a* or 320*b*. In more detail, the depth D of the second or third storage chamber 320*a* or 320*b* is greater than 0.7 times the height H2 or H3 of the second or third storage chamber 320*a* or 320*b*.

However, the barrier 500 of the present invention is not used only if the depth of the storage chambers is great and may be used regardless of the depths or heights of the respective storage chambers as long as the barrier 500 is used to divide the storage chambers from each other.

Further, the refrigerator 1000 of the present invention includes first communication parts formed on the side surfaces of the barrier 500 and second communication parts formed on the side surface of the inner case 300 opposite the first communication parts. That is, the first communication parts and the second communication parts are parts passing through the side surfaces of the barrier 500 and the side surfaces of the inner case 300 from side to side. Therefore, if the barrier 500 is assembled with the inside of the inner case 300, the first communication parts and the second communication parts communicate with each other.

Therethrough, the foaming liquid injected into the outer case 100 passes through the second communication parts and the first communication parts and fills the inside of the barrier 500. Thereafter, the foaming liquid is integrally solidified within the barrier 500 and a case (the space between the inner case 300 and the outer case 100) through the first communication parts and the second communication parts during foaming. Therefore, cool air may not leak from a gap between the barrier 500 and the inner case 300 and the strength of the cabinet of the refrigerator 1000 may be increased.

Further, the refrigerator 100 in the present invention may include communication paths 700 communicating the barrier 500 and the inner case 300 with each other. The communication paths 700 refer to paths formed by communicating the first communication parts and the second communication parts with each other.

The communication paths 700 communicate the space between the inner case 300 and the outer case 100 (hereinafter, referred to as 'an inner space of a case') and the inner space of the barrier 500 with each other.

In a general refrigerator, a foamed heat insulating material is provided only between an inner case and an outer case and prevents cool air from leaking to the outside of the refrigerator or to exchange heat with the outside.

Polyurethane foam is generally used as the foamed heat insulating material. Polyurethane foam includes urethane bonds between an alcohol (OH) group and an isocyanate (NCO) group and is generated through reaction using a catalyst, such as water, such as a foaming agent to accelerate foaming. Polyurethane foam is a thermosetting resin. Owing to carbon dioxide generated by the foaming agent, i.e., water, porous polyurethane foam having cells of micrometer units is formed.

When the foaming liquid of polyurethane foam is injected into the space between the outer case 100 and the inner case 300 and heated, polyurethane reaction is carried out for a designated time and porous polyurethane foam having cells of micrometer units is formed due to carbon dioxide and the foaming agent isolated during the reaction. Since the volume of polyurethane foam is greater than the volume of the foaming liquid, polyurethane foam fully fills the space between the outer case 100 and the inner case 300 and applies foaming pressure to the outer case 100 and the inner case 300 and, thus, the surface of the inner case 300 formed of plastic becomes flat.

The foaming liquid injected into the space between the outer case 100 and the inner case 300 through the filling holes 120 provided on the outer case 100 is injected into the barrier 500 through the communication paths 700 and fills the inside of the barrier 500.

Thereby, during foaming of the foaming liquid (a process of blowing the foaming liquid and filling the space between the outer case 100 and the inner case 300 with the foaming liquid), the foaming liquid within the space between the outer case 100 and the inner case 300 and the foaming liquid within the inner space of the barrier 500 are simultaneously foamed and solidified. Then, an integrally foamed heat insulating material fills the inner space of the barrier 500 and the space between the outer case 100 and the inner case 300.

The cabinet having a single foamed heat insulating material has no gap between the barrier 500 and the inner case 300 and excellent cool air cut-off effects between the storage chambers 320*a* and 320*b*, does not require a process of separately installing the barrier 500 filled with a foamed heat insulating material within the inner case 300 to reduce process costs, and allows the barrier 500 and the case (the inner case 300 and the outer case 100) to be filled with the single solidified foamed heat insulating material to have excellent strength quality of the cabinet (including the barrier 500 and the case).

The communication paths 700 are provided on the side surfaces of the inner case 300. Further, the communication paths 700 are provided on the side surfaces of the barrier 500. In more detail, the communication paths 700 are provided on the left and right side surfaces of the inner case 300 and the left and right side surfaces of the barrier 500 and, thereby, the side surfaces of the barrier 500 and the side surfaces of the inner case 300 communicate with each other.

Further, the communication paths 700 are provided at the front parts of the side surfaces of the inner case 300 and the side surfaces of the barrier 500. That is, the communication paths 700 include front communication paths 720 provided on the side surfaces of the inner case 300 so as to be separated backwards from the front surface of the inner case 300 by a designated distance. In this case, the designated distance is L1. L1 is an optimized value determined through experimentation.

With reference to FIG. 2, filling of the space between the inner case 300 and the outer case 100 with the foaming liquid through the filling holes 120 will be described.

When the inner case 300 is assembled with the inside of the outer case 100 and then the space between the inner case 300 and the outer case 100 is filled with the foaming liquid, the inner case 300 and the outer case 100 are laid down such that the front parts of the inner case 300 and the outer case 100 face the ground surface.

The reason for this is that, since the length of the refrigerator 1000 in the upward and downward directions is greater than the length of the refrigerator 1000 in the leftward and rightward directions and the length of the refrigerator 100 in the forward and backward directions, the foamed heat insulating material may fill the entirety of the space between the inner case 300 and the outer case 100 only if the inner case 300 and the outer case 100 are laid down such that the opened part of the inner case 300 is closed. Further, the reason for this is that the positions of the filling holes 120 are located on the rear surface of the outer case 100.

Therefore, the foaming liquid, injected into the inner case 300 through the filling holes 120 under the condition that the inner case 300 is laid down, may not fill only the space between the inner case 300 and the outer case 100 but may fill the height of L1 and flow into the barrier 500 to fill the inside of the barrier 500.

Thereby, the foaming liquid within the inner space of the barrier 500 and the inner space of the case is simultaneously foamed so as to cause the inner space of the barrier 500 and the inner space of the case to be filled with the foamed heat insulating material, and the inner space of the barrier 500 and the inner space of the case are uniformly filled with the foamed heat insulating material.

FIG. 3 is a view illustrating communication paths 700 through which the barrier 500 and the inner case 300 communicate with each other.

With reference to FIG. 3, the communication paths 700 will be described in more detail.

When the foaming liquid, injected under the condition that the inner case 300 is laid down such that the front part thereof faces the ground surface, is heated, polyurethane foam (hereinafter, referred to as the foamed heat insulating material) swells in the upward direction. That is to say, the foamed heat insulating material fills the inner space of the barrier 500 and the inner space of the case in a direction from the front parts to the rear parts of the barrier 500 and the case.

Since the area of the inner space of the barrier 500 is smaller than the area of the inner space of the case, the foamed heat insulating material more rapidly fills the inner space of the barrier 500 in the direction from the front part to the rear part of the barrier 500 and flows to the inner space of the case through the communication paths 700 to fill the inner space of the case.

However, when the foamed heat insulating material introduced into the case from the barrier 500 through the communication paths 700 and the foamed heat insulating material originally swelling within the case meet, the foaming pressure of the inner space of the case is excessively raised.

An excessively high foaming pressure causes protruding of the outer surface of the outer case 100 or generates protrusions on the outer surface of the outer case 100. Otherwise, an excessively high foaming pressure causes distortion of the entire shape of the inner case 300 and the outer case 100. That is, the side surfaces of the outer case 100 may be curved or depressed.

Therefore, the foaming speed of the foamed liquid introduced from the barrier 500 to the outer case 100 needs to be adjusted.

In order to solve such problems, the communication paths 700 in the present invention will be configured, as below.

The communication paths 700 may have a polygonal shape but are not limited thereto. That is, the communication paths 700 may have any shape, such as a circular or oval shape, as long as the communication paths 700 communicate the inside of the barrier 500 and the inner case 300 with each other. As exemplarily shown in FIG. 3, the communication paths 700 have a rectangular shape having a long length in the forward and backward directions.

Otherwise, the communication paths 700 in accordance with the present invention may have a polygonal shape in which the vertical length of the front part of the communication path 700 is smaller than the vertical length of the rear part of the communication path 700.

Otherwise, the communication paths 700 may be configured such that the area of the communication path 700 decreases in the forward direction. Otherwise, the communication paths 700 may be configured such that the vertical length of the communication path decreases in the forward direction.

That is to say, if the communication path 700 has a rectangular shape, the communication path 700 includes an inclined part 702 inclined upwards in the forward direction and formed at the upper or lower corner thereof and this means that the vertical length from the inclined part 702 to the other corner decreases.

The above-described shape of the communication paths 700 may prevent generation of an excessively high foaming pressure in the case. Because a part in the case to which an excessively high foaming pressure is applied is affected by the foaming pressure of the foamed heat insulating material which is foamed in the initial stage and introduced into the case. Therefore, the above-described shape of the communication paths 700 may reduce the amount of the foamed heat insulating material introduced into the case from the barrier 500 and this may reduce the foaming pressure of the foamed heat insulating material and prevent deformation of the outer surface of the outer case 100.

The first communication part includes injection channels 704 provided to divide the communication path 700 and the injection channels 704 may have a circular or polygonal shape. That is to say, the injection channels 704 are a flow path to substantially communicate the barrier 500 and the inner case 300 with each other among the overall area of the inner circumferential surface of the communication path 700, and the foaming liquid or the foamed heat insulating material moves therethrough.

A plurality of injection channels 704 may be provided within the communication path 700 and the area of the flow path to communicate the barrier 500 and the inner case 300 with each other increases in proportion to the number of the injection channels 704.

The number of the injection channels 704 provided at the front part of the communication path 700 may be smaller than the number of the injection channels 704 provided at the front part of the communication path 700. Further, as exemplarily shown in FIG. 3, the area of the injection channels 704 provided at the front part of the communication path 700 may be smaller than the area of the injection channels 704 provided at the rear part of the communication path 700.

The injection channels 704 serve to adjust a foaming speed when a flow of the foamed heat insulating material is generated due to a foaming pressure difference between the barrier 500 and the case during foaming and thus to prevent deformation of the outer case 100 or distortion of the entirety of the case, as described above.

Here, by reducing the number of the injection channels 704 provided at the front part of the communication path 700 or reducing the area of the injection channels 704 provided at the front part of the communication path 70, the injection channels 704 serve to reduce a foaming speed due to a foaming pressure difference between the barrier 500 and the case (the inner case 300 and the outer case 100) during foaming at the initial stage of foaming.

However, the communication paths 700 or the injection channels 704 are provided at a designated size or in designated number as they become close to the rear part of the inner case 300. The reason for this is that a foaming pressure difference between the barrier 500 and the case (inner case 300 and the outer case 100) is not great at the later stage of foaming, as compared to the initial stage of foaming.

The communication paths 700 may include front communication paths 720 provided at the front parts of the side surfaces of the inner case 300 and rear communication paths 740 separated from the front communication paths 720 by a designated distance in the backward direction.

Here, the designated distance is L2 and L2 is a value set through experimentation.

The above-described characteristics of the communication paths 700 may be applied to the front communication paths 720. For example, the front communication paths 720 may be configured such that the area of the front communication path 720 decreases in the forward direction and configured such that the number or area of injection channels 704 provided on the front communication path 720 decreases in the forward direction.

Further, the area of the front communication paths 720 may be smaller than the area of the rear communication paths 740. This serves to solve problems caused by a foaming pressure difference between the barrier 500 and the case, generated at the initial stage of foaming, and a detailed description thereof will be omitted.

The front communication paths 720 are provided at the front parts of the side surfaces of the inner case 300 and serve as paths through which the foaming liquid passes and paths through which the foamed heat insulating material passes during foaming.

The rear communication paths 740 are provided at the rear parts of the side surfaces of the inner case 300 and, particularly, provided at the middle parts when the side surfaces of the inner case 300 are divided into three equal parts. That is, the rear communication paths 740 are provided at the rear parts of the inner case 300, as compared to the front communication paths 720, but are not provided close to the rear surface of the inner case 300.

Since the front communication paths 720 and the rear communication paths 740 are provided on the side surfaces of the inner case 300 so as to be separated from each other by a designated distance L2, when the foamed heat insulating material is solidified, the inner case 300 and the barrier 500 corresponding to the designated distance L2 are fixed in the solidified foamed heat insulating material. Therefore, since the barrier 500 is fixed so as not to move in the forward and backward directions and the front part or rear part of the barrier 500 does not move in the upward and downward directions, deformation of the barrier 500, such as distortion of the barrier 500, may be prevented.

FIG. 4 is a side view illustrating the cross-section of the barrier 500 provided within the inner case 300 and FIG. 5 is a cross-sectional view of the barrier 500 provided within the inner case 300.

With reference to FIGS. 4 and 5, first stair parts 520 provided on the barrier 500 and insertion holes 340 provided on the inner case 300 will be described.

The first stair parts 520 protrude in a convex shape from the side surfaces of the barrier 500. Further, the insertion holes 340 are provided so that the first stair parts 520 may be inserted into the insertion holes 340 and pass through the insertion holes 340. Therefore, the first stair parts 520 may be supported by the insertion holes 340 and the barrier 500 may be supported by the side surfaces of the inner case 300.

Further, the first stair parts 520 inserted into the insertion holes 340 protrude to the space between the inner case 300 and the outer case 100. That is to say, the length of the first stair parts 520 is greater than the thickness of the inner case 300.

Therefore, the first stair parts 520 protruding toward the inner space of the case increase a surface area coming into surface contact with the foamed heat insulating material and cause the foamed heat insulating material and the barrier 500 to be firmly attached to each other.

Further, the first stair parts 520 and the insertion holes 340 have the same shape. That is, the outer surfaces of the first stair parts 520 and the inner surfaces of the insertion holes 340 are provided in the same shape.

Therefore, such a shape prevents the foamed heat insulating material from flowing to the inside of the storage chamber 320*a* through gaps between the insertion holes 340 and the first stair parts 520 during foaming.

Further, the communication paths 700 are provided on the first stair parts 520.

That is to say, the communication path 700 is provided at one end of the first stair part 520 and, in other words, the communication path 700 is surrounded by the end of the first stair part 520.

Therefore, the first stair part 520 is inserted into the inner space of the case through the insertion hole 340 and the first communication part is provided at the end of a second stair part 540. That is, the communication path 700 is provided on the inner circumferential surface of the second stair part 540.

Further, the first stair parts 520 may be provided such that the area of the first stair part 520 decreases in the forward direction. Such a structure of the first stair parts 520 is the same as that of the front communication paths 720 and a detailed description thereof will thus be omitted.

Hereinafter, a structure to support the barrier 500 on the inner case 300 will be described.

The inner case 300 of the present invention includes support parts 360 depressed in a concave shape within the storage space 320, and the barrier 500 is supported by the support parts 360. That is to say, the support parts 360 are convex in a direction from the inner case 300 to the outer case 100.

The support parts 360 may be symmetrically provided on the left and right side surfaces of the inner case 300 and be further provided on the rear portion of the inner case 300. Therefore, the side surfaces of the barrier 500 are inserted into the support parts 360 and, thus, the support parts 360 support the barrier 500 in the upward and downward directions.

That is, if the barrier 500 is assembled with the inner case 300, when a producer pushes the side surfaces of the barrier 500 in the backward direction from an area in front of the inner case 300 using the support parts 360 as guides, the support parts 360 support the side surfaces of the barrier 500 and prevent the barrier 500 from falling down.

The insertion holes 340 are provided at the support parts 360. In more detail, the insertion holes 340 are provided within the support parts 360. In this case, the first stair parts 520 provided on the side surfaces of the barrier 500 may be inserted into the insertion holes 340.

In more detail, under the condition that the barrier 500 is assembled with the support parts 360, the first stair parts 520 are inserted into the insertion holes 340 and protrude to the inner space of the case.

Therefore, the first stair parts 520 serve as stoppers to prevent the barrier 500 from moving in the forward and backward directions.

Further, the refrigerator 100 in accordance with the present invention includes the second stair parts 540 protruding in a convex shape from the barrier 500 and the second stair parts 540 are supported by the support parts 360.

In more detail, the second stair parts 540 protrude from the side surfaces of the barrier 500 and the first stair parts 520 protrude from the second stair parts 540.

In this case, the second stair parts 540 are supported by the support parts 360 and the first stair parts 520 are inserted into the insertion holes 340 provided on the support parts 360. Further, the side surfaces of the barrier 500, on which the second stair parts 540 are not provided, contact the inner surface of the inner case 300.

Thereby, there is no gap between the barrier 500 and the inner case 300, leakage of the foamed heat insulating material to the storage chamber 320*a* through gaps between the barrier 500 and the inner case 300 during foaming is prevented, and the barrier 500 is more firmly fixed to the inside of the inner case 300. Further, the barrier 500 and the inner case 300 may more closely adhered to each other.

FIG. 6 is a perspective view of the barrier 500.

With reference to FIG. 6, the barrier 500 will be described in more detail.

The barrier 500 includes an upper barrier part 502 and a lower barrier part 504.

Although the barrier 500 may be one member manufactured by casting, the upper barrier part 502 and the lower barrier part 504 of the barrier 500 of the present invention may be respective members in consideration of ease, convenience and costs in processing.

If the barrier 500 includes the upper barrier part 502 and the lower barrier part 504, the above-described first stair parts 520 and second stair parts 540 are respectively provided on the first barrier part 502 and the lower barrier part 504.

That is to say, a part protruding from the upper barrier part 502 and a part protruding from the lower barrier part 504 form one first stair part 520. Therefore, when the foamed heat insulating material is solidified after the first stair parts 520 are inserted into the insertion holes 340, the upper barrier part 502 and the lower barrier part 502 may be combined into a single unit like one member.

In order to reinforce the barrier 500, the barrier 500 may include deformation prevention ribs 506 on the upper and/or lower surface of the barrier 500.

That is, the deformation prevention ribs 506 may be provided on the upper barrier part 502 and/or the lower barrier part 504.

A plurality of deformation prevention ribs 506 in a convex shape may be provided and thus form a furrow structure.

Although the deformation prevention ribs 506 may be provided in the leftward and rightward directions, the deformation prevention ribs 506 in the present invention may be provided in the forward and backward directions.

The reason for this is that, since the foamed heat insulating material swells in a direction from the front part to the rear part of the barrier 500 within the barrier 500 during foaming, in order to disperse the foaming pressure of the front part of the barrier 500 toward the rear part of the barrier 500, the deformation prevention ribs 506 are provided in the forward and backward directions.

In order to couple the upper barrier part 502 and the lower barrier part 504 to each other, the barrier 500 may further include hooks 508*a* and hook fixing parts 508*b*.

The hooks 508*a* are provided on the upper barrier part 502 or the lower barrier part 504, the hook fixing parts 508*b* are provided on the upper barrier part 502 or the lower barrier part 504 not provided with the hooks 508*a*.

Since the hooks 508*a* and the hook fixing parts 508*b* need to be provided at a region where the upper barrier part 502 and the lower barrier part 504 meet, the hooks 508*a* and the hook fixing parts 508*b* are provided on the side surfaces of the upper barrier part 502 and the lower barrier part 504.

FIG. 7 is a view illustrating a structure to fix a post 560 provided in the barrier 500.

With reference to FIG. 7, the post 560 provided between the upper barrier part 502 and the lower barrier part 504 will be described.

The posts 560 are provided within the barrier 500, particularly, between the upper barrier part 502 and the lower barrier part 504, and prevent deformation of the barrier 500 during foaming.

Further, the barrier 500 of the present invention may include the post 560 protruding from the upper barrier part 502, a post insertion part 562 provided at the end of the post 560, and a post fixing part 564 provided on the lower barrier part 504 so that the post insertion part 562 is inserted into the post fixing part 564.

The post fixing part 564 includes a reception part 566 provided therein to receive the post insertion part 562, and the outer circumferential surface of the post insertion part 562 corresponds to the inner circumferential surface of the reception part 566.

The post insertion part 562 may have a circular or polygonal shape.

If the post insertion part 562 is inserted into the reception part 566 and thus provided within the post fixing part 564, a bolt hole 568 passing through the post insertion part 562 and the post fixing part 564 is provided.

That is, the bolt hole 568 is formed by connecting a hollow provided within the post insertion part 562 and a hollow provided within the post fixing part 564 to each other.

The bolt hole 568 passes through the lower portion of the lower barrier part 504, and a bolt 570 is inserted into the bolt hole 568 from the lower portion of the lower barrier part 504 and couples the post fixing part 564 and the post insertion part 562 to each other. Thereby, the upper barrier part 502 and the lower barrier part 504 are not separated from each other despite foaming pressure but are fixed to each other.

The upper barrier part 502 and/or the lower barrier part 504 may further include adsorption ribs 580 protruding to the inner space of the barrier 500. FIG. 3 illustrates the adsorption ribs 580 as being provided on the lower barrier part 504. Hereinafter, the adsorption ribs 580 provided on the lower barrier part 504 will be described and such a description may be applied to the upper barrier part 502.

The adsorption ribs 580 are formed integrally with the lower barrier part 504 by molding. The adsorption ribs 580 are provided in the forward and backward directions of the lower barrier part 504 and have a designated height. Therefore, the adsorption ribs 580 increase the inner surface area of the lower barrier part 504.

The adsorption ribs 580 increases a contact surface area between the foamed heat insulating material and the inner surface of the barrier 500 when the foaming liquid is foamed, thus increasing adsorption three between the barrier 500 and the foamed heat insulating material.

The reason why the adsorption ribs 580 are provided in the forward and backward directions is that, as the foamed heat insulating material fills the barrier 500 in the backward direction from the front part of the barrier 500, the foamed heat insulating material is solidified and the solidification time of the foamed heat insulating material varies. Therefore, the foamed heat insulating material solidified at different times is adsorbed and adhered onto the surfaces of the absorption ribs 580 and, thus, adsorption force between the barrier 500 and the foamed heat insulating material is improved.

Although not shown in this figure, the refrigerator 1000 of the present invention may further include sub-communication paths (not shown) provided on the rear surface of the inner case 300 so as to communicate the barrier 500 and the inner case 300 with each other. The above description of the communication paths 700 may be applied to the sub-communication paths (not shown) and a detailed description of the sub-communication paths (not shown) will be omitted.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A refrigerator comprising:

an outer case;

an inner case provided within the outer case and including a storage space;

a barrier disposed within the storage space to vertically divide the storage space formed in the inner case into a plurality of storage chambers, and including first communication parts on the side surfaces of the barrier;

second communication parts formed on the inner case opposite the first communication parts;

a foamed heat insulating material filling the inside of the barrier by causing a foaming liquid, injected from the outer case, to pass through the second communication parts and the first communication parts and then foaming the foaming liquid within the barrier;

first stair parts protruding in a convex shape from the side surfaces of the barrier around the first communication parts; and insertion holes provided on the inner case so that the first stair parts are inserted into the insertion holes and protrude to a space between the inner case and the outer case, wherein the first communication parts and the second communication parts communicate with each other to form communication paths, and wherein a vertical length of the communication paths gradually decrease in a forward direction.

2. The refrigerator according to claim 1, wherein an area of the communication paths gradually decreases in the forward direction.

3. The refrigerator according to claim 1, wherein the first communication parts include injection channels provided to divide the communication paths, and the injection channels have a circular or polygonal shape.

4. The refrigerator according to claim 3, wherein an area of the injection channels provided at the front portion of the first communication parts is smaller than an area of the injection channels provided at the rear portion of the first communication parts.

5. The refrigerator according to claim 1, wherein outer circumferential surfaces of the first stair parts and inner circumferential surfaces of the insertion holes have a same shape.

6. The refrigerator according to claim 1, further comprising support parts depressed in a concave shape within the storage space of the inner case, wherein the barrier is supported by the support parts.

7. The refrigerator according to claim 6, further comprising second stair parts protruding in a convex shape from the barrier, wherein the second stair parts are supported by the support parts.

8. The refrigerator according to claim 1, further comprising deformation prevention ribs formed in a convex shape on the upper surface or lower surface of the barrier to prevent deformation of the barrier.

9. The refrigerator according to claim 1, wherein:

the barrier includes an upper barrier part and a lower barrier part; and a plurality of posts are provided between the upper barrier part and the lower barrier part to prevent deformation of the barrier during foaming.

10. The refrigerator according to claim 9, wherein each post protrudes from the upper barrier part and includes:

a post insertion part provided at a first end of each of the plurality of posts; and a post fixing part provided on the lower barrier part so that the post insertion part is inserted into the post fixing part.

11. The refrigerator according to claim 1, wherein the barrier includes adsorption ribs formed integrally with the barrier within the barrier to increase a contact surface area between the foamed heat insulating material and the barrier.

12. A refrigerator comprising:

an outer case;

an inner case provided within the outer case and including a storage space;

a barrier disposed within the storage space to vertically divide the storage space formed in the inner case into a plurality of storage chambers, and including first communication parts on the side surfaces of the barrier;

second communication parts formed on the inner case opposite the first communication parts;

a foamed heat insulating material filling the inside of the barrier by causing a foaming liquid, injected from the outer case, to pass through the second communication parts and the first communication parts and then foaming the foaming liquid within the barrier;

first stair parts protruding in a convex shape from the side surfaces of the barrier around the first communication parts; and insertion holes provided on the inner case so that the first stair parts are inserted into the insertion holes and protrude to a space between the inner case and the outer case, wherein the first communication parts and the second communication parts communicate with each other to form communication paths, and wherein the communication paths include front communication paths provided at front portions of the side surfaces of the inner case and rear communication paths provided at a rear of the front communication paths.

13. The refrigerator according to claim 12, wherein an area of the front communication paths is smaller than an area of the rear communication paths.

14. The refrigerator according to claim 12, wherein an area of the front communication paths or the rear communication paths gradually decreases in a forward direction.

15. A refrigerator comprising:

an outer case;

an inner case provided within the outer case and including a storage space;

a barrier disposed within the storage space to vertically divide the storage space formed in the inner case into a plurality of storage chambers, and including first communication parts on the side surfaces of the barrier;

second communication parts formed on the inner case opposite the first communication parts;

a foamed heat insulating material filling the inside of the barrier by causing a foaming liquid, injected from the outer case, to pass through the second communication parts and the first communication parts and then foaming the foaming liquid within the barrier;

first stair parts protruding in a convex shape from the side surfaces of the barrier around the first communication parts; and insertion holes provided on the inner case so that the first stair parts are inserted into the insertion holes and protrude to a space between the inner case and the outer case, wherein the first stair parts are provided such that an area of the first stair parts gradually decrease in a forward direction.

16. A refrigerator comprising:

an outer case;

an inner case provided within the outer case and including a storage space;

a barrier disposed within the storage space to vertically divide the storage space formed in the inner case into a plurality of storage chambers, and including first communication parts on the side surfaces of the barrier;

second communication parts formed on the inner case opposite the first communication parts;

a foamed heat insulating material filling the inside of the barrier by causing a foaming liquid, injected from the outer case, to pass through the second communication parts and the first communication parts and then foaming the foaming liquid within the barrier;

first stair parts protruding in a convex shape from the side surfaces of the barrier around the first communication parts; and insertion holes provided on the inner case so that the first stair parts are inserted into the insertion holes and protrude to a space between the inner case and the outer case, wherein the first communication parts are provided at one end of each of the first stair parts.

* * * * *